US009139991B2

(12) United States Patent
Huber

(10) Patent No.: US 9,139,991 B2
(45) Date of Patent: Sep. 22, 2015

(54) FLOOR DRAIN VALVE WITH RESILIENTLY MOUNTED RIGID FLAPPERS

(75) Inventor: Kevin Dean Huber, Tacoma, WA (US)

(73) Assignee: The RectorSeal Corporation, Houston, TX (US)

( * ) Notice: Subject to any disclaimer, the term of this patent is extended or adjusted under 35 U.S.C. 154(b) by 0 days.

(21) Appl. No.: 13/362,221

(22) Filed: Jan. 31, 2012

(65) Prior Publication Data

US 2012/0192950 A1 Aug. 2, 2012

Related U.S. Application Data

(60) Provisional application No. 61/438,074, filed on Jan. 31, 2011.

(51) Int. Cl.

| | |
|---|---|
| ***F16K 1/22*** | (2006.01) |
| ***E03C 1/298*** | (2006.01) |
| *E03C 1/24* | (2006.01) |

(52) U.S. Cl.

CPC ..... *E03C 1/298* (2013.01); *E03C 2001/2413* (2013.01); *Y10T 29/49826* (2015.01); *Y10T 137/0318* (2015.04); *Y10T 137/6988* (2015.04)

(58) Field of Classification Search

CPC ..... F16K 15/144; F16K 15/148; Y10T 137/6988; Y10T 137/0318; Y10T 29/49826; E03C 2001/2413

USPC ..... 137/362, 512.1, 512.15, 27, 843, 852, 137/854, 527, 856, 15.25

See application file for complete search history.

(56) References Cited

U.S. PATENT DOCUMENTS

| | | | |
|---|---|---|---|
| 155,669 | A | 10/1874 | Painter |
| 171,817 | A | 1/1876 | Kahl |

(Continued)

FOREIGN PATENT DOCUMENTS

| | | | |
|---|---|---|---|
| CH | 313441 | A | 4/1956 |
| IT | 495000 | A | 6/1954 |
| WO | WO 96/19620 | A1 | 6/1996 |

OTHER PUBLICATIONS

U.S. Appl. No. 14/210,103, including its prosecution history, the cited references, and the Office Actions therein, Huber, Not yet published.

(Continued)

*Primary Examiner* — Kevin Lee
*Assistant Examiner* — P. Macade Nichols
(74) *Attorney, Agent, or Firm* — Knobbe Martens Olson & Bear LLP

(57) ABSTRACT

An improved floor drain valve for buildings, basements, exterior paved areas, and the like. The invention provides floor drain assemblies and check valves providing improved drainage performance, particularly where drainage is an irregular occurrence, and having unprecedented simplicity and reliability. Floor drains according to the invention comprise check valves having elastomeric hinge structures mounting relatively rigid flapper structures biased upwardly against sealing surfaces adapted for disposition within floor drains. Water entering the valve structure opens the flapper valves by gravitational forces downwardly against the relatively rigid flapper, and after passage of the water, the valve is elastomerically urged into the sealed position restricting back flow of gases from the downstream area of the drain conduit and permitting pressure testing of the downstream conduit.

26 Claims, 3 Drawing Sheets

(56) References Cited

U.S. PATENT DOCUMENTS

| | | | | |
|---|---|---|---|---|
| 194,329 | A | | 8/1877 | Buhrer |
| 555,588 | A | | 3/1896 | Spencer |
| 803,979 | A | | 11/1905 | Bonnell |
| 1,137,516 | A | | 4/1915 | Moon |
| 1,749,098 | A | | 11/1926 | Boosey |
| 1,720,819 | A | | 7/1929 | Cohen |
| 1,771,770 | A | | 7/1930 | Bruno |
| 1,867,478 | A | | 7/1932 | Stelzner |
| 1,871,536 | A | * | 8/1932 | Le Bus ..... 137/515 |
| 1,948,220 | A | | 2/1934 | Kennedy |
| 2,049,340 | A | | 7/1936 | Van Der Horst et al. |
| 2,132,636 | A | | 10/1938 | Maahs |
| 2,211,212 | A | | 8/1940 | Langdon |
| 2,270,737 | A | | 1/1942 | Langdon |
| 2,279,257 | A | | 4/1942 | Svirsky |
| 2,292,003 | A | | 8/1942 | Yant et al. |
| 2,299,116 | A | | 10/1942 | Svirsky |
| 2,299,434 | A | | 10/1942 | Svirsky |
| 2,322,631 | A | | 6/1943 | Groeniger |
| 2,348,097 | A | | 5/1944 | Smith |
| 2,369,939 | A | | 2/1945 | Betts |
| 2,371,449 | A | | 3/1945 | Langdon |
| 2,516,578 | A | | 7/1950 | Kreiner |
| 2,524,764 | A | | 10/1950 | Burke |
| 2,562,533 | A | | 7/1951 | Dunlap |
| 2,578,590 | A | | 12/1951 | Perrault |
| 2,579,855 | A | | 12/1951 | Pockel et al. |
| 2,594,318 | A | | 4/1952 | Langdon |
| 2,596,182 | A | | 5/1952 | Sosaya |
| 2,598,002 | A | | 5/1952 | Langdon |
| 2,629,393 | A | | 2/1953 | Langdon |
| 2,646,063 | A | | 7/1953 | Hayes |
| 2,655,178 | A | | 10/1953 | Sarosdy |
| 2,675,823 | A | | 4/1954 | Langdon |
| 2,725,075 | A | | 11/1955 | Irgens |
| 2,777,464 | A | | 1/1957 | Mosely |
| 2,787,376 | A | | 4/1957 | Coulson |
| 2,912,999 | A | | 11/1959 | Kersh |
| 2,913,000 | A | | 11/1959 | Roberts |
| 2,922,380 | A | | 1/1960 | Pedlow, Jr. |
| 2,927,609 | A | | 3/1960 | Vanderlans |
| 2,936,779 | A | | 5/1960 | Kindred |
| 2,997,050 | A | | 8/1961 | Ferguson |
| 3,047,013 | A | | 7/1962 | Baumbach |
| 3,059,637 | A | | 10/1962 | Senne |
| 3,060,882 | A | | 10/1962 | Peters et al. |
| 3,091,259 | A | | 5/1963 | Alessio |
| 3,107,687 | A | | 10/1963 | Howe |
| 3,116,751 | A | | 1/1964 | Hamilton |
| 3,118,468 | A | | 1/1964 | Bochan |
| 3,132,685 | A | | 5/1964 | Mc Kinnon |
| 3,154,106 | A | | 10/1964 | Nooy |
| 3,228,418 | A | | 1/1966 | Rosback et al. |
| 3,241,571 | A | | 3/1966 | Garcia |
| 3,268,018 | A | | 8/1966 | Neilson |
| 3,289,693 | A | * | 12/1966 | Scaramucci ..... 137/858 |
| 3,312,237 | A | * | 4/1967 | Mon et al. ..... 137/512.15 |
| 3,319,268 | A | | 5/1967 | Blumenkranz |
| 3,327,379 | A | | 6/1967 | Clements |
| 3,335,741 | A | | 8/1967 | Liljendahl |
| 3,354,903 | A | | 11/1967 | Caruso |
| 3,392,409 | A | | 7/1968 | Politz |
| 3,442,295 | A | | 5/1969 | Ver Nooy |
| 3,448,766 | A | | 6/1969 | Schule |
| 3,457,959 | A | | 7/1969 | Cooper |
| 3,463,189 | A | | 8/1969 | Fitzpatrick |
| 3,467,271 | A | | 9/1969 | Kaiser et al. |
| 3,519,012 | A | | 7/1970 | Van Patten |
| 3,542,057 | A | | 11/1970 | Staiano |
| 3,605,132 | A | | 9/1971 | Lineback |
| 3,610,270 | A | | 10/1971 | Attle |
| 3,707,986 | A | | 1/1973 | Breen |
| 3,712,115 | A | | 1/1973 | Miller |
| 3,730,218 | A | | 5/1973 | Rydberg |
| 3,762,437 | A | | 10/1973 | King, Sr. |
| 3,766,947 | A | | 10/1973 | Osburn |
| 3,768,505 | A | | 10/1973 | Benke |
| 3,775,780 | A | | 12/1973 | McEwen |
| 3,822,720 | A | | 7/1974 | Noyce |
| 3,858,604 | A | | 1/1975 | Bender et al. |
| 3,911,949 | A | | 10/1975 | Hilden et al. |
| 3,919,880 | A | | 11/1975 | Seyd et al. |
| 3,941,156 | A | | 3/1976 | Metzger |
| 3,952,340 | A | | 4/1976 | Cuschera |
| 3,969,847 | A | | 7/1976 | Campagna et al. |
| 3,990,439 | A | | 11/1976 | Klinger |
| 4,009,366 | A | | 2/1977 | Danell |
| 4,040,450 | A | | 8/1977 | Boundy |
| 4,052,759 | A | | 10/1977 | Hill |
| 4,054,152 | A | | 10/1977 | Ito et al. |
| 4,064,912 | A | | 12/1977 | Petrone |
| 4,086,668 | A | | 5/1978 | Tubbs |
| 4,088,149 | A | | 5/1978 | Logsdon |
| 4,098,287 | A | | 7/1978 | Baumbach |
| 4,132,111 | A | | 1/1979 | Hasha |
| 4,132,241 | A | | 1/1979 | Iannelli |
| 4,142,371 | A | | 3/1979 | Mayfield |
| 4,163,509 | A | | 8/1979 | Amneus |
| 4,168,621 | A | | 9/1979 | Kreitenberg |
| 4,175,592 | A | | 11/1979 | Coone |
| 4,180,875 | A | | 1/1980 | Wilson |
| 4,192,339 | A | | 3/1980 | Fisher |
| 4,194,252 | A | | 3/1980 | Tsuei |
| 4,194,721 | A | | 3/1980 | Nachtigahl |
| 4,202,377 | A | | 5/1980 | Harrison |
| 4,203,473 | A | | 5/1980 | Roberson, Sr. |
| 4,212,486 | A | | 7/1980 | Logsdon |
| 4,222,407 | A | | 9/1980 | Ruschke et al. |
| 4,232,704 | A | | 11/1980 | Becker et al. |
| 4,232,706 | A | | 11/1980 | Ericson |
| 4,289,166 | A | | 9/1981 | Haines |
| 4,296,778 | A | | 10/1981 | Anderson |
| 4,306,447 | A | | 12/1981 | Franks, Jr. |
| 4,376,597 | A | | 3/1983 | Britton et al. |
| 4,406,480 | A | | 9/1983 | Izzi |
| 4,407,171 | A | | 10/1983 | Hasha et al. |
| 4,416,308 | A | | 11/1983 | Bower |
| 4,423,526 | A | | 1/1984 | Izzi, Sr. |
| 4,429,568 | A | | 2/1984 | Sullivan |
| 4,460,019 | A | | 7/1984 | Condon |
| 4,494,575 | A | | 1/1985 | Gladstone |
| 4,535,807 | A | | 8/1985 | Ericson |
| 4,542,642 | A | | 9/1985 | Tagliarino |
| 4,594,739 | A | | 6/1986 | Watts et al. |
| 4,602,504 | A | | 7/1986 | Barber |
| 4,607,664 | A | | 8/1986 | Carney et al. |
| 4,610,246 | A | | 9/1986 | Delphia |
| 4,624,131 | A | | 11/1986 | Holm et al. |
| 4,632,151 | A | | 12/1986 | Glover |
| 4,658,861 | A | | 4/1987 | Roberson, Sr. |
| 4,669,131 | A | | 6/1987 | Barlow |
| 4,706,482 | A | | 11/1987 | Barber |
| 4,712,574 | A | | 12/1987 | Perrott |
| 4,729,401 | A | | 3/1988 | Raines |
| 4,744,109 | A | | 5/1988 | Yuill |
| 4,756,982 | A | | 7/1988 | McCartney, Jr. |
| 4,762,149 | A | | 8/1988 | Pickl, Jr. |
| 4,763,510 | A | | 8/1988 | Palmer |
| 4,780,915 | A | | 11/1988 | Cuschera |
| 4,821,559 | A | | 4/1989 | Purpora |
| 4,823,411 | A | | 4/1989 | Nettel |
| 4,827,539 | A | | 5/1989 | Kiziah |
| 4,836,151 | A | | 6/1989 | Litjens et al. |
| 4,838,262 | A | | 6/1989 | Katz |
| 4,848,155 | A | | 7/1989 | Huber |
| 4,870,992 | A | | 10/1989 | Irwin et al. |
| 4,873,730 | A | | 10/1989 | Cuschera |
| 4,887,646 | A | | 12/1989 | Groves |
| 4,890,483 | A | | 1/1990 | Vetter |
| 4,936,338 | A | | 6/1990 | Fonoimoana |
| 4,936,350 | A | | 6/1990 | Huber |
| 5,005,603 | A | | 4/1991 | Amundson et al. |
| 5,014,739 | A | | 5/1991 | Csaszar |
| 5,033,510 | A | | 7/1991 | Huber |

(56) References Cited

U.S. PATENT DOCUMENTS

| | | | | | |
|---|---|---|---|---|---|
| 5,070,896 | A | | 12/1991 | Warren | |
| 5,076,095 | A | | 12/1991 | Erhardt | |
| 5,099,887 | A | | 3/1992 | Hooper | |
| 5,115,554 | A | | 5/1992 | Fell, Sr. | |
| 5,159,953 | A | * | 11/1992 | Sato et al. | 137/527.8 |
| 5,163,480 | A | | 11/1992 | Huber | |
| 5,181,543 | A | | 1/1993 | Hendzel | |
| 5,277,171 | A | | 1/1994 | Lannes | |
| 5,287,730 | A | | 2/1994 | Condon | |
| 5,297,581 | A | | 3/1994 | Godfrey | |
| 5,301,707 | A | | 4/1994 | Hofsteenge | |
| 5,323,641 | A | | 6/1994 | Tolliver et al. | |
| 5,323,804 | A | | 6/1994 | Lin | |
| 5,325,885 | A | | 7/1994 | Ivan et al. | |
| 5,330,437 | A | | 7/1994 | Durman | |
| 5,377,361 | A | | 1/1995 | Piskula | |
| 5,419,359 | A | | 5/1995 | Kor | |
| 5,419,366 | A | | 5/1995 | Johnston | |
| 5,507,501 | A | | 4/1996 | Palmer | |
| 5,518,026 | A | * | 5/1996 | Benjey | 137/512.15 |
| 5,601,112 | A | | 2/1997 | Sekiya et al. | |
| 5,606,995 | A | | 3/1997 | Raftis | |
| 5,623,971 | A | | 4/1997 | Foernzler | |
| 5,662,138 | A | | 9/1997 | Wang | |
| 5,709,309 | A | | 1/1998 | Gallagher et al. | |
| 5,727,593 | A | | 3/1998 | Duer | |
| 5,740,830 | A | | 4/1998 | Mankins | |
| 5,797,426 | A | | 8/1998 | Powell | |
| 5,844,127 | A | | 12/1998 | Berube et al. | |
| 5,927,762 | A | | 7/1999 | Webb | |
| 5,996,134 | A | | 12/1999 | Senninger | |
| 6,032,515 | A | | 3/2000 | Huber | |
| 6,082,183 | A | | 7/2000 | Huber | |
| 6,085,362 | A | | 7/2000 | Huber | |
| 6,085,363 | A | | 7/2000 | Huber | |
| 6,209,584 | B1 | | 4/2001 | Huber | |
| 6,234,195 | B1 | | 5/2001 | Kippe et al. | |
| 6,237,625 | B1 | | 5/2001 | Randolph | |
| 6,273,124 | B1 | | 8/2001 | Huber et al. | |
| 6,318,397 | B1 | | 11/2001 | Huber et al. | |
| 6,367,505 | B1 | | 4/2002 | Raftis et al. | |
| 6,626,201 | B1 | | 9/2003 | Kim | |
| 6,719,003 | B2 | | 4/2004 | Schroeder et al. | |
| 6,719,004 | B2 | * | 4/2004 | Huber et al. | 137/362 |
| 6,827,105 | B1 | | 12/2004 | Marble et al. | |
| 7,509,978 | B1 | | 3/2009 | Currid | |
| 7,900,288 | B2 | | 3/2011 | Fima | |
| 8,201,576 | B2 | * | 6/2012 | Klein | 137/512.15 |
| 2012/0152388 | A1 | | 6/2012 | Stanaland | |

OTHER PUBLICATIONS

U.S. Appl. No. 13/362,900, including its prosecution history, the cited references, and the Office Actions therein, filed Feb. 7, 2013, Huber.

U.S. Appl. No. 14/082,018, including its prosecution history, the cited references, and the Office Actions therein, Huber, Not yet published.

* cited by examiner

FLOOR DRAIN VALVE WITH RESILIENTLY MOUNTED RIGID FLAPPERS

CROSS REFERENCE TO RELATED APPLICATIONS

This application is a non-provisional of and claims the benefit of priority to U.S. provisional Patent Application Ser. No. 61/438,074, filed on Jan. 31, 2011, the disclosure of which is hereby expressly incorporated by reference in its entirety.

The present disclosure relates to valves for floor drains. More particularly it relates to valves useful in drains for building floors, basements, and exterior paved areas to prevent backflow of gases, and in pressure testing the drain system downstream of the valve for leaks and other anomalies.

BACKGROUND

Traditionally, U-shaped or "gooseneck" traps have been used in the plumbing industry to prevent backflow of harmful or undesirable sewer or pipe gasses into buildings while permitting drainage of unwanted liquid from floors and other generally horizontal surfaces. Such traps operate by leaving a small quantity of fluid within the lower portion of a U-shaped trap section to act as a gas barrier. In many applications, however, particularly where access is difficult or where drainage is infrequent, gooseneck traps are not optimal. Fluid in gooseneck trap may evaporate from the trap, permitting free flow of obnoxious gasses through the drain, insects may breed in the fluid, or in some instances the fluids may harden so as to actually block or restrict flow through the drain. Such conventional drains are also relatively difficult and expensive to install.

Drains with check valves have been developed to overcome some of the shortcomings of the gooseneck traps. See, For example, U.S. Pat. No. 6,273,124 to Huber et al and U.S. Pat. No. 6,719,004 to Huber et al. Such drains are effective in facilitating draining operations and in trapping drain-pipe gasses and preventing backflow. However, check valve type drains with further improvement in their effectiveness, manufacturability, reliability, and ease of use are desirable. Check valves with the ability to resist back pressure from the drain in order to test for leakage or other anomalies would be desirable.

SUMMARY

The present disclosure provides floor drains of improved simplicity and reliability and to permit pressure testing of the drain beneath the valve. One embodiment of the present disclosure provides a floor drain assembly that includes: a drain basin configured to be inserted into a floor, and a check valve configured to be inserted into and secured in the lower end of the drain basin from the upper open end of the drain basin. According to an embodiment of the present disclosure the check valve includes a substantially cylindrical body having an inlet end and an opposed outlet end, and a relatively rigid flapper mounted to the valve body with a resilient hinge and positioned within the cylindrical body at an angle such that a portion of an upper periphery edge of the flapper is connected to the cylindrical body, and wherein the rigid flapper is configured to deflect downwardly from a resilient hinge structure to allow fluid to pass through the cylindrical body of the check valve. In an alternate embodiment two substantially semicircular relatively rigid flapper elements are attached with a resilient hinge each at an upper end thereof to a diametrically positioned mounting structure, with the lower peripheral edge of each flapper resiliently urged upwardly into sealing contact with a downwardly facing sealing surface. When water flows upon the upper surface of the flapper structures, the flapper structures open permitting passage of the water, and then reseal resiliently against the sealing surface to prevent gases from the downstream conduits from passing upwardly past the flapper valves, permitting pressure testing of the downstream conduits.

In accordance with some embodiments a flapper mount is provided at an inside surface of a cylindrical body portion of the drain component, a flapper stop is provided on the inside surface of the cylindrical body between the flapper mount and an outlet end of the cylindrical body, and a flapper is connected to the flapper mount and engaged with the flapper stop and configured to move away from the flapper stop to allow liquid that enters the inlet of the drain to exit through the outlet of the drain.

Gaskets providing multiple positioning rings and sealing rings are contemplated to fit in the various drain conduit configurations encountered in the field.

The present disclosure also provides a method of draining a floor while preventing the backflow of gas under pressure thereby permitting pressure testing of the conduit downstream of the valve. The method according to one embodiment includes the step of positioning a rigid flapper within a cylindrical body such that a peripheral edge of the rigid flapper adjacent an inlet of the cylindrical body is resiliently and flexibly attached to the cylindrical body by a resilient hinge, or to a mount located on a diameter of the cylindrical body, and a peripheral edge of the rigid flapper adjacent the outlet of the cylindrical body is urged into sealing relationship with a sealing surface but is free to deflect towards the outlet to open the valve permitting downward flow of liquids therethrough. In addition the valve configuration is adapted to resist back pressure from the drain so that the drain may be tested for leakage. The features of the present disclosure are described in greater detail below.

DETAILED DESCRIPTION

Figure 1:
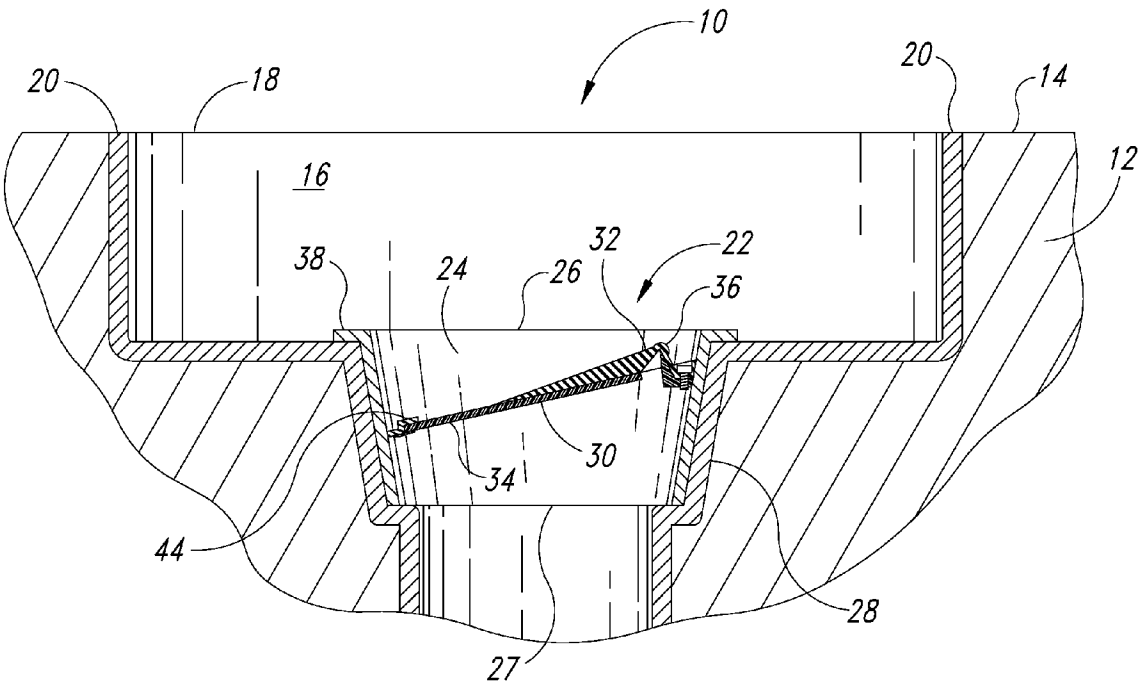
FIG. 1 is a cross-section view of an embodiment of a floor drain valve assembly inserted into a floor.
Figure 1B:
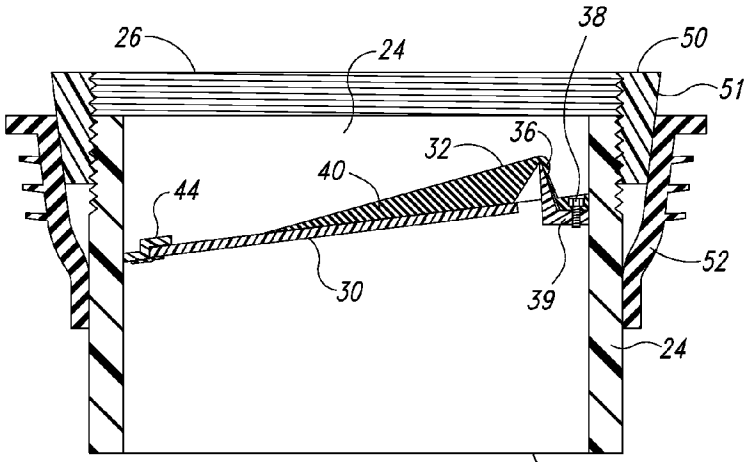
FIG. 1B is a cross sectional view of the drain assembly of FIG. 1 with the flapper in closed position.
Figure 1C:
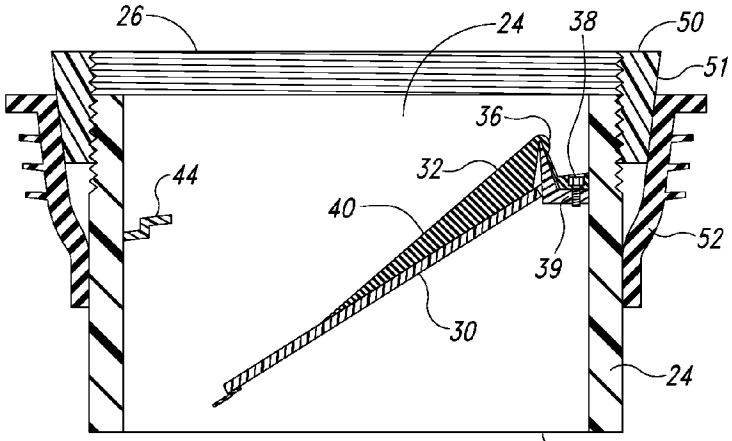
FIG. 1C is a cross sectional view of the drain assembly of FIG. 1A with the flapper in open position forced by the presence of water and allowing water to flow through the valve structure.
Figure 1A:
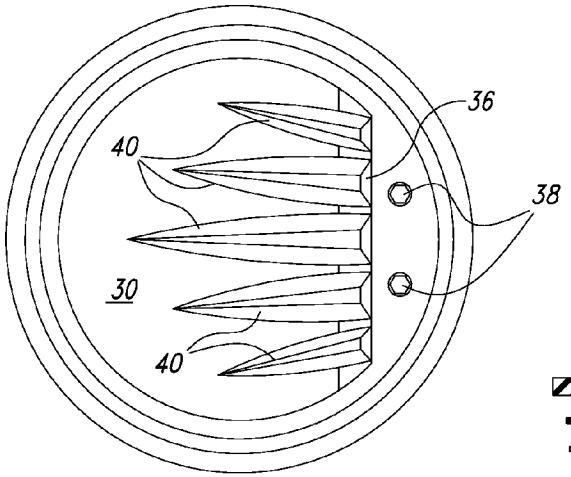
FIG. 1A is a plan view of the drain assembly of FIG. 1 with side mounted rigid flapper resiliently mounted to the valve body according to the present disclosure.

Referring to FIGS. 1 and 1A-C, a first embodiment of the floor drain valve assembly of the present disclosure is described. The floor drain assembly 10 is shown inserted into a floor 12, flush with a drain surface 14. The assembly includes a drain basin 16 with in inlet 18 and an outlet 28. In the depicted embodiment the inlet 18 is larger than the outlet 28 and both are circular in shape. It should be appreciated that the drain basin 16 can be configured differently in alternative embodiments.

In the depicted embodiment a check valve assembly 22 is positioned in the drain basin between the inlet 20 and outlet 28 of the drain basin 16. The check valve assembly 22 includes a generally cylindrical body 24, an inlet 26, and an outlet 27. In the depicted embodiment, the inlet 26 is arranged opposite the outlet 28. Between the inlet 26 and outlet 28 is a rigid flapper 30 that is configured and arranged to be urged by a resilient hinge 36 into a normally closed position against seal surface 44 to prevent gasses from flowing back from the outlet 28 of the cylindrical body 24 through the inlet 26. When water is present on the upper surface of rigid flapper 30, the resilient hinge 36 permits the rigid valve flapper to rotate downwardly and break the seal so that the water may flow downwardly into the conduit below.

The flapper 30 is constructed of a material which is sufficiently rigid to resist elevated back pressures from the conduit below the valve. Flapper 30 has reinforcing ridges 40 extending from the resilient hinge 36 at least part way across the upper surface of flapper 30. Flapper 30 is fastened to cylindrical body 24 using alignment pin 38 placed into aperture 39. The flapper 30 is configured and arranged to pivot around its resilient hinge 36 into an open position to allow liquid to flow freely from the inlet 26 through the outlet 28 of the cylindrical body 24. In the depicted embodiment the flapper 30 is disposed at an angle within the cylindrical body 24 with a fixed portion 32 of the flapper 30 positioned closer to the inlet 26, and the free portion 34 of the flapper 30 positioned closer to the outlet 28. In the depicted embodiment the free portion 34 of the flapper 30 is positioned below the fixed portion 32 of the flapper 30. The fixed portion 32 of the flapper is secured to a resilient flapper mount hinge 36. The flapper is constructed of a relatively rigid material which is mounted with a resilient mount which biases the flapper upwardly into sealing relationship with the sealing surface 44. The downwardly angled arrangement of the flapper 30 within the cylindrical body 24 enables the flapper 30 to be easily opened (lowering the free end of the flapper from its normally closed position) due to water flow from the inlet 26 to the outlet 28. The downwardly angled arrangement also prevents opening of the flapper due to gas flow from the outlet 28 to the inlet 26.

In FIGS. 1-B and 1-C an arrangement for fastening the valve body into the drain conduit and sealing the exterior thereof is shown. Threaded collar 50 is shown engaging the upper part of body 24 and the interior surface of gasket 52. When threaded collar 50 is rotated into its operable position, the tapered exterior surface 51 forces gasket 52 outwardly into engagement with the interior surface of the drain conduit. This configuration both seals the exterior area of the valve body 24 with respect to the drain conduit and locks the valve body in place to resist upwardly directed pressure forces from gases within the conduit.

In the depicted embodiment the check valve 22 is configured to be inserted into or removed from the drain basin 16 via the inlet 18 of the basin. In the depicted embodiment the cylindrical body 24 includes a tapered outer profile and a stop 38 adjacent the inlet 26. The tapered outer profile prevents the check valve 22 from becoming lodged within the drain basin 16. The stop 38 is configured to engage an edge of the drain basin 16 to locate and secure the check valve assembly 22 in the drain basin 16. In the depicted embodiment the stop 38 is shown as a flange or shoulder that extends outwardly from the inlet 26 of the cylindrical body 24. It should be appreciated that alternative configurations of the cylindrical body 24 are also possible.

In the depicted embodiment the flapper is constructed of a relatively rigid material such as various types of plastics well known in the art and is mounted with a resilient hinge structure. As the gasses from the outlet 28 push against the flapper 80, it bends towards the inlet and the periphery edge 82 presses against the flapper stop and forms a tight seal to prevent the gasses from moving past the flapper.

Figure 2B:
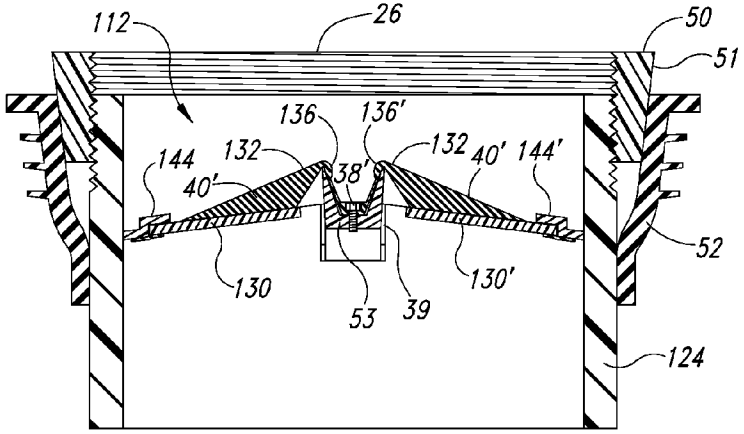
FIG. 2B is a cross sectional view taken along lines 3-3 of FIG. 2A with the flappers in closed position.
Figure 2C:
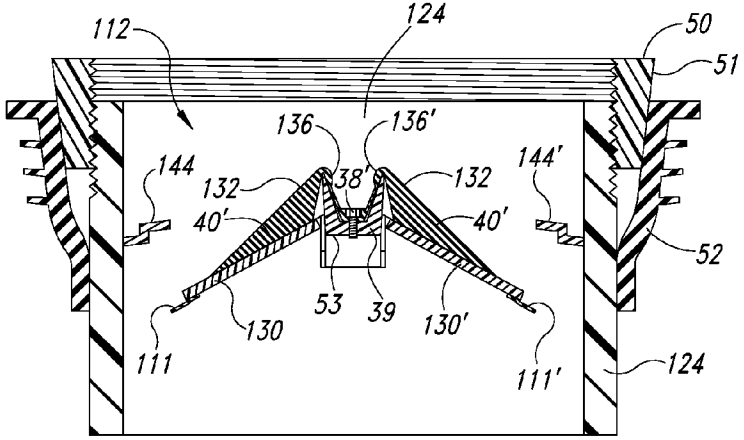
FIG. 2C is a cross sectional view taken along lines 3-3 of FIG. 2A with the flappers in open position forced by the presence of water and allowing water to flow through the valve structure.
Figure 2A:
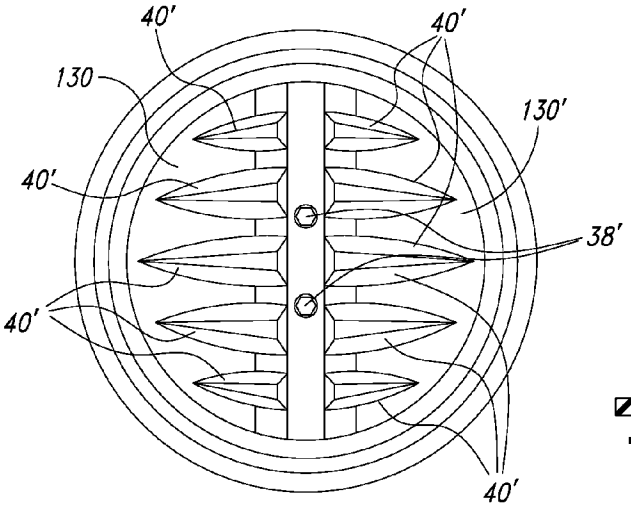
FIG. 2A is a plan view of a second embodiment of a drain assembly with center mounted rigid flappers resiliently mounted to the valve body according to the present disclosure.

In the depicted embodiment the locking member, flapper stop, and flapper mount cooperate to secure the flapper so that when the flapper is in its normally closed position, the flapper is seals against the sealing surface and prevents backflow of gases through the valve structure. The flexibility in the mounting hinge (e.g., the elastic memory of the hinge) urges the peripheral edge of the flapper against the flapper stop such that a seal is formed between the flapper and the flapper stop. In the depicted embodiment the flapper mount extends inwardly and is generally horizontally and the flapper stop is positioned on the inside surface of the cylindrical body at an angle relative to the horizontal. See, for example, FIG. 1B. In the depicted embodiment, the periphery edge of the flapper is generally in the same plane. Therefore, when the flapper is mounted to the flapper mount and engaged with the flapper stop, the flapper mounting hinge is flexed while the flapper remains substantially planar. An alternate embodiment, particularly useful in larger diameter drain conduits is shown in FIGS. 2A-C. In this embodiment, two flappers 130 and 130' are used, mounted on a diametrically located mount 53. Each flapper 130 is relatively rigid and mounted with an elastomeric hinge 136 and 136' to bias the rigid flapper upwardly so that the peripheral edges 111 and 111' seals against the sealing surface 144 and 144'. Flapper 130 and 130' have reinforcing ridges 40' extending from the resilient hinges 136 and 136' at least part way across the upper surface of flappers 130 and 130'. Flappers 130 and 130' are fastened to cylindrical body 124 using alignment pins 38 placed into aperture 39. Whenever water comes into contact with flapper 130 and 130' by flowing into area 112, the weight of the water causes flapper hinge 136 and 136' to bend, permitting flappers 130 and 130' to rotate downwardly, unsealing the rigid flapper 130 and 130' from seat 144 and 144' respectfully and thereby permitting flow of water past the flapper valve structure. When the water clears, the elastomeric properties of the hinge 136 and 136' causes the rigid flappers to re-seal against seats 144 and 144'.

The preferred method for fixing the valve body having two flappers into the drain conduit is the same as that described above for the single flapper embodiment.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A check valve for a floor drain comprising:

a cylindrical body, including an inlet end and an opposed outlet end;

a flapper mount connected to an inside surface of the cylindrical body;

a flapper stop positioned on the inside surface of the cylindrical body between the flapper mount and the outlet end of the cylindrical body; and a relatively rigid flapper connected to said flapper mount, said flapper having a resilient hinge and reinforcing ridges to provide rigidity to said flapper, said flapper being rotatable from a first closed position engaged with the flapper stop, wherein the flapper is configured to move away from the flapper stop to allow liquid that enters the inlet to exit the check valve through the outlet and when in the closed position prevents backflow of gases, wherein the resilient hinge biases the flapper toward the closed position and the flapper is positioned at an angle within the cylindrical body with a fixed portion of the flapper positioned closer to the inlet of the cylindrical body and a free portion of the flapper positioned closer to the outlet end of the cylindrical body.

2. The check valve of claim 1, wherein the flapper stop comprises a flange that extends from the inside surface of the cylindrical body.

3. The check valve of claim 1 having two flappers with resilient hinges, each mounted on a mount positioned on a diameter of the valve body.

4. A floor drain assembly comprising:

a drain basin configured to be inserted into a floor, the drain basin including an upper end and a lower end, wherein the area of the upper end is greater than the area of the lower end;

a check valve configured to be secured between the upper and lower ends of the drain basin, the check valve being configured to be inserted and removed from the drain basin from the upper end of the drain basin, the check valve including:

a cylindrical body, including an inlet end, an opposed outlet end, and a tapered outer profile;

a relatively rigid flapper positioned within a portion of the cylindrical body that includes the tapered outer profile, the flapper positioned at an angle within the drain basin with a fixed portion of the flapper positioned closer to the upper end of the drain basin and a free portion of the flapper positioned closer to the lower end of the drain basin, said flapper having a resilient hinge, wherein a portion of an upper periphery edge of the flapper is connected to the cylindrical body, and wherein a portion of a lower periphery edge is configured to deflect to allow fluid to pass through the cylindrical body of the check valve;

whereby liquids may pass downwardly through said check valve and gases from below said check valve are prevented from upward movement.

5. The floor drain assembly of claim 4, wherein an outer diameter of the cylindrical body at the inlet end is greater than an outer diameter of the cylindrical body at the outlet end.

6. A method of draining a floor while preventing the backflow of gas comprising:

positioning a relatively rigid flapper having a resilient hinge within a cylindrical body such that a peripheral edge of the flapper is fixed to the cylindrical body adjacent an inlet of the cylindrical body, said resilient hinge biasing said flapper into sealing relationship with a sealing surface permitting said flapper to rotate downwardly towards the outlet when water is present on an upper surface of said flapper and the flapper is positioned at an angle within the cylindrical body with a fixed portion of the flapper positioned closer to the inlet of the cylindrical body and a free portion of the flapper positioned closer to the outlet end of the cylindrical body.

7. The method of claim 6, further comprising slidably engaging the cylindrical body into a drain basin.

8. The method of claim 6 further including the step of applying fluid pressure in the conduit below said valve to test said conduit for leaks.

9. The method of claim 1, wherein the flapper is sized such that only a single flapper is required to prevent backflow of gases when the flapper is in the closed position.

10. The method of claim 6, wherein a single flapper is positioned within the cylindrical body.

11. The check valve of claim 1, wherein the ridges have a greatest depth adjacent the fixed portion of the flapper.

12. The check valve of claim 1, wherein the ridges have a greatest width adjacent the fixed portion of the flapper.

13. The check valve of claim 12, wherein the ridges have a greatest depth adjacent the fixed portion of the flapper.

14. The check valve of claim 1, wherein the ridges taper in thickness and width from the fixed portion of the flapper to the free portion of the flapper.

15. The check valve of claim 1, further comprising a threaded collar that engages an upper exterior surface of the cylindrical body.

16. The check valve of claim 15, further comprising a gasket having an interior surface that engages the exterior surface of the cylindrical body and an exterior surface of the threaded collar.

17. The floor drain assembly of claim 4, wherein the flapper has reinforcing ridges extending from the resilient hinge.

18. The floor drain assembly of claim 17, wherein the ridges have a greatest width adjacent the fixed portion of the flapper.

19. The floor drain assembly of claim 17, wherein the ridges taper in thickness and width from the fixed portion of the flapper to the free portion of the flapper.

20. The method of claim 6, further comprising engaging a gasket having an interior surface with the exterior surface of the cylindrical body and an exterior surface of the threaded collar.

21. The floor drain assembly of claim 4, further comprising a threaded collar that engages an upper exterior surface of the cylindrical body.

22. The floor drain assembly of claim 21, further comprising a gasket having an interior surface that engages the exterior surface of the cylindrical body and an exterior surface of the threaded collar.

23. The method of claim 6, wherein the flapper has reinforcing ridges extending from the resilient hinge.

24. The method of claim 23, wherein the ridges have a greatest width adjacent the fixed portion of the flapper.

25. The method of claim 23, wherein the ridges taper in thickness and width from the fixed portion of the flapper to the free portion of the flapper.

26. The method of claim 6, further comprising engaging a threaded collar with an upper exterior surface of the cylindrical body.

* * * * *